United States Patent [19]

Hudon et al.

[11] Patent Number: 4,919,336

[45] Date of Patent: Apr. 24, 1990

[54] SHOWER PIPES

[75] Inventors: James D. Hudon, Beaconsfield; Lionel T. Bloyce, Maidenhead, both of England

[73] Assignee: Albany International Corp., Menands, N.Y.

[21] Appl. No.: 73,750

[22] Filed: Jul. 10, 1987

[30] Foreign Application Priority Data

Jul. 14, 1986 [GB] United Kingdom ..... 8617100

[51] Int. Cl.[5] ..... D21F 1/42

[52] U.S. Cl. ..... 239/11; 162/275; 239/396; 239/553; 239/562

[58] Field of Search ..... 239/11, 396, 553, 553.5, 239/559, 562, 566, 567, DIG. 13; 162/275, 308–310; 134/122 R

[56] References Cited

U.S. PATENT DOCUMENTS

| | | | |
|---|---|---|---|
| 1,186,226 | 6/1916 | Parker | 239/553 |
| 1,966,573 | 7/1934 | Webb | 239/553.5 |
| 2,321,431 | 6/1943 | Somes | 239/553.5 |
| 2,755,859 | 7/1956 | Dow et al. | 239/553 |
| 3,263,933 | 8/1966 | Porwancher | 239/553 X |
| 3,269,165 | 8/1966 | Anderson | 239/553 X |
| 3,737,101 | 6/1973 | Johnson . | |
| 3,966,544 | 6/1976 | Johnson | 239/562 X |
| 4,340,177 | 7/1982 | Huber . | |
| 4,455,224 | 6/1984 | Kaiser | 209/211 |

FOREIGN PATENT DOCUMENTS

| | | | |
|---|---|---|---|
| 386391 | 12/1922 | Fed. Rep. of Germany | 239/553 |
| 828950 | 2/1960 | United Kingdom . | |
| 845607 | 8/1960 | United Kingdom . | |
| 993692 | 6/1965 | United Kingdom . | |
| 1119449 | 7/1968 | United Kingdom . | |

*Primary Examiner*—Andres Kashnikow

*Attorney, Agent, or Firm*—Kane, Dalsimer, Sullivan, Kurucz, Levy, Eisele & Richard

[57] ABSTRACT

A shower pipe (9) for use in the papermaking industry has a series of nozzles (13) through which jets of water are directed at a surface to be treated (for example, a filter screen or a pepermaker's felt). To prevent the nozzles becoming blocked by particles separating out of the water (particularly when the water has been recycled), a partition (24) or insert (33) is located within the shower pipe to define a passageway of reduced cross-sectional area through which water flows to the nozzles, with a preferred minimum velocity of 8 ft/sec.

13 Claims, 2 Drawing Sheets

SHOWER PIPES

The present invention relates to shower pipes and, more especially, to shower pipes for use in the paper-making industry.

Showers are used at various stages in the papermaking process, for example to clean and/or recondition conveying surfaces and to clean filters that are used for treating waste water. A shower fitting commonly used in the paper-making industry comprises a hollow shower pipe which is closed or restricted at one end and connected, at the other end, to a source of cleaning-/reconditioning fluid (usually water). The pipe has apertures along its length through which the cleaning-/reconditioning fluid is discharged in jets, and the apertures contain nozzles to produce jets of various sizes and shapes (eg, needle-or fan-shaped).

The shower can be stationary or it can move relative to the surface to be treated. For example, if the shower pipe is used to clean/recondition a papermaker's felt, it can extend across the felt and be reciprocated lengthwise. If, on the other hand, the shower pipe is used to clean a circular screen, it can extend radially outwards from the centre of the screen and rotate over the screen about an axis at the centre.

A problem that is often encountered in shower pipes, especially those used in the papermaking industry, is blockage of the nozzle apertures. The problem occurs frequently when the fluid supplied to the shower is filtered, or otherwise recycled, water (even though individual particles remaining in the water after recycling are small enough to pass easily through the nozzle orifices) and is likely to increase with the increasing tendency, in the papermaking industry, to use recycled water and thereby reduce consumption of fresh water. The problem can be overcome by installing brushes within a shower pipe for cleaning the nozzle orifices and also the interior of the pipe, or by using so-called purgable nozzles (that is, nozzles through which a purging fluid can be passed, at intervals, to clean the nozzle orifices). These solutions are, however, comparatively complex.

It is an object of the present invention to enable blockage of the nozzles of a shower pipe to be avoided in a comparatively simple manner.

The present invention provides a shower pipe comprising a pre-selected pipe which is closed or restricted at one end and the other end of which is connectible to supply of fluid, and a fluid supply passageway within the pipe from the said other end to a plurality of fluid discharge nozzles along the length of the pipe, the cross-sectional area available for fluid flow within the pipe being less than the cross-sectional area of the interior of the pre-selected pipe over part at least of the length of the pipe.

Preferably the cross-sectional area of the passageway is such that the minimum fluid velocity in the passageway is sufficient substantially to prevent separation of solids from fluid within the passageway. A minimum fluid velocity in the passageway, at least at the first nozzle of 8 ft/sec (2.6 m/sec) is desirable.

The cross-sectional area of the passageway need not be constant along its length: it may, for example, decrease towards the said one end of the pipe.

The fluid passageway may be defined by at least one member located within the pipe. In one embodiment of the invention, the fluid passageway is defined by at least one partition within the pipe. In other embodiments, an insert is located in the pipe such that the remaining space within the pipe constitutes the fluid passageway.

Alternatively, the pre-selected pipe may be deformed to reduce the cross-sectional area of the interior of the pipe.

The invention further provides a method of producing a shower pipe from a pre-selected cylindrical pipe which is closed or restricted at one end, and within which is a fluid passageway extending from the other end to a plurality of fluid discharge nozzles along the length of the pipe; the method including the step of restricting the cross-sectional area of the fluid passageway to increase the fluid velocity therein to a level sufficient to prevent separation of solids from the fluid.

The present invention also provides a method of operating shower apparatus comprising at least one shower pipe which is closed or restricted at one end, the other end being connected to a supply of fluid, and within which is a fluid passageway extending from the said other end to a plurality of fluid discharge nozzles along the length of the pipe; the method including the steps of causing fluid to flow in the passageway and restricting the cross-sectional area of the passageway to increase the fluid velocity to a level sufficient to prevent separation of solids from the fluid.

By way of example, shower pipes constructed in accordance with the invention will now be described with reference to the accompanying drawings, in which.

Figure 1:
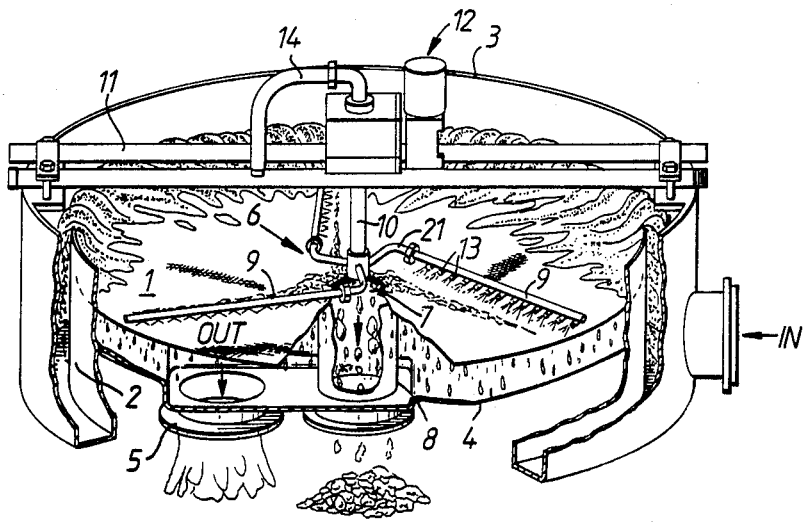
FIG. 1 is a diagrammatic illustration, partly broken away, of a filtering device incorporating several shower pipes, each being in accordance with the invention.

The filtering device shown in FIG. 1 has a circular filter screen 1 which extends across the top of a cylindrical container 2. Liquid to be filtered flows onto the screen 1 at its periphery from a cylindrical tank 3 which surround the container 2. The liquid being filtered, together with any very fine solids, passes through the screen 1 and collects in the dish-shaped floor 4 of the container 2 from where it runs out through an outlet pipe 5. Solids remain on the screen 1 and are directed, by a spray of water from a rotating shower 6, towards an outlet opening 7 at the centre of the screen. The solids pass through the opening 7 and into an outlet pipe 8 for subsequent collection.

The shower 6 comprises three horizontal shower pipes 9 which extend radially outwards, over the screen 1, from a shaft 10 located on the vertical axis of the container 2. The shaft 10 extends downwards from a support beam 11 located diametrically across the tank 3 and is rotated by a motor 12 mounted on the support beam. Each shower pipe 9 has a series of nozzles 13 and, in use, is supplied with water via the shaft 10 from a conduit 14. The nozzles 13 are directed inwardly towards the centre of screen 1, so that the jets of water from the nozzles will urge solids on the screen towards the outlet opening 7.

Filtering devices of the type shown in FIG. 1 are known and are used in, for example, the papermaking industry for treating waste water. To reduce consumption of fresh water, the shower 6 is often supplied with filtered or otherwise recycled water.

Figure 2:
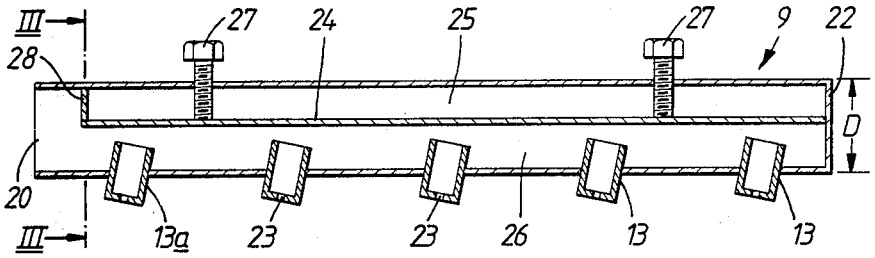
FIG. 2 is a longitudinal cross-section through one of the shower pipes of the device of FIG. 1.
Figure 3:
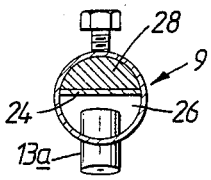
FIG. 3 is a view of the line III—III of FIG. 2.

The construction of a shower pipe 9 is shown in greater detail in FIGS. 2 and 3. The inner end 20 of the pipe is open and, in the device shown in FIG. 1, is connected to the rotatable shaft 10 by an angled pipe 21. The outer end 22 of the pipe is closed. The nozzles 13 are located in apertures in the pipe and, as already mentioned, are inclined so that the spray of water from the nozzle orifices 23 is directed inwards towards the centre of the screen 1. The nozzles 13 shown in FIGS. 2 and 3 are of a basic form and would normally be of more complex construction selected to produce spray jets of a required shape and size.

The cross-sectional diameter D of the pipe 9 is determined mainly by structural and manufacturing considerations. Thus, the requirement that the pipe should not bend under the weight of water that it carries, despite being unsupported at its outer end, together with the requirement that installation of the nozzles 13 should not present undue difficulty, generally imposes a predetermined minimum value on the cross-sectional diameter D. Typically, if the pipe length is 450 mm the minimum internal diameter would be 26.5 mm.

The shower pipe 9 as so far described is generally effective but it is found that the nozzle orifices 23 can become blocked during use, despite the fact that the water supplied to the shower pipe has been filtered and that any particles remaining in the water are small enough to pass through the nozzle orifices. Investigation shows that the problem can very largely be overcome by decreasing the effective cross-sectional area of the flow path within the pipe 9, thereby increasing the velocity of the water within the pipe. The pipe 9 itself, however, remains of the predetermined minimum size selected to meet the structural and manufacturing requirements described above.

The effective cross-sectional area of the pipe 9 can be decreased in a number of ways, one of which is illustrated in FIGS. 2 and 3. An elongated partition 24 is inserted into the pipe to divide the bore of the pipe, lengthwise, into two spaces 25, 26 one of which (26) contains the nozzles 13. Bolts 27 inserted through the wall of the pipe 9 into the second space 25 and in a direction perpendicular to the partition 24, contact the partition 24 and urge it into contact, along each side, with the internal surface of the pipe. The end of the space 25 adjacent the inlet end 20 of the shower pipe is closed by an end piece 28.

Water entering the shower pipe 9 is now confined to the space 26 and flows to the nozzles 13 with increased velocity. It is thought that the increase in velocity discourages and particles in the water from separating out and subsequently collecting together to block the nozzle orifices 23. Preferably, the cross-sectional area of the passageway formed by space 26 is such that the water has a minimum velocity of approximately 8 ft/sec (2.6 m/sec), at least at the first nozzle 13a, and the location of the partition 24 is selected accordingly.

Figure 4:
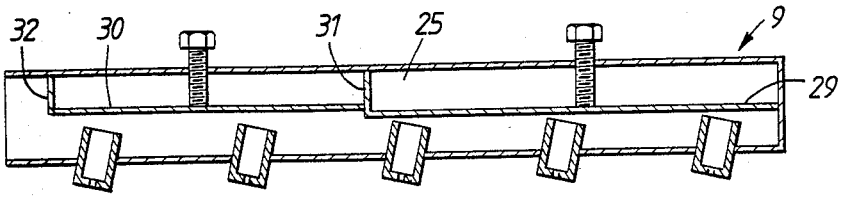
FIGS. 4 to 6 are longitudinal cross-sections through other forms of shower pipes.

In the arrangement illustrated in FIGS. 2 and 3, the passageway 26 is of constant cross-section along its length. In some circumstances, however, it may be advantageous to vary the cross-sectional area of the passageway 26 and, in particular, to decrease the area towards the outer end of the pipe, where the flow of water is reduced. Preferably, the decrease in cross-sectional area of the passageway 26 is such that a minimum flow velocity of 8 ft/sec (2.6 m/sec) is maintained along its length. This can be achieved by, for example, using two partitions 29, as shown in FIG. 4, the combined length of the partitions being comparable to the length of the single partition 24 of FIGS. 2 and 3. One partition 29 is narrower than the other so that it will sit lower down in the pipe 9 (as seen in the drawings): this partition is located at the outer end of the pipe and that part of the space 25 defined by this partition is closed by an end piece 31. The second partition 30 is then inserted in the pipe with one end adjacent the end piece 31 and that part of the space 25 defined by this partition is closed by an end piece 32. The flow passageway 26 of this arrangement is of reduced cross-sectional area towards the outer end of the pipe 9, the reduction occurring abruptly at the junction between the partitions 29, 30.

It will be appreciated that a similar arrangement having more than two partitions could be employed if required. It may, for example, be desirable to have a reduction in the cross-sectional area of the passageway 26 in the region of each of the nozzles 13.

Figure 5:
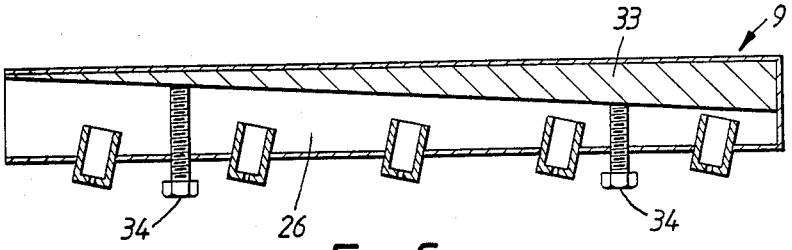

Another arrangement, in which the cross-sectional area of the flow passage 26 reduces continuously along the length of the pipe, is shown in FIG. 5. In this case the pipe 9 contains a solid insert 33 the cross-section of which increases continuously towards the outer end of the pipe. The insert 33 can be formed by, for example, pouring a suitable material into the pipe and allowing the material to harden while the pipe is held at an angle to produce the required taper. Bolts 34 inserted through the wall of the pipe, in this case into the flow passage 26, contact the insert 33 and hold it in position.

It will be appreciated that the insert 33 need not be tapered but could have a constant cross-section along the length of the pipe.

Figure 6:
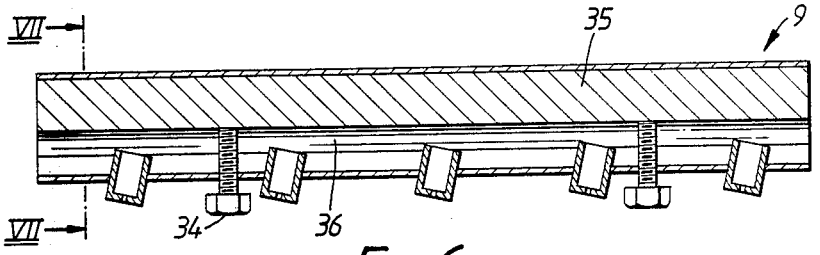
Figure 7:
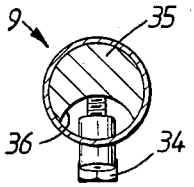
FIG. 7 is a view on the line VII—VII of FIG. 6.

FIGS. 6 and 7 show another arrangement in which the pipe 9 contains a solid insert but, in this case, the insert is formed before it is located in the pipe. The insert comprises a rod 35 having a circular cross-section which substantially fills the pipe. Part of the rod is machined away to form a channel 36 through which water flows to the nozzles. The channel 36 is shown as having a constant cross-section along the length of the rod 35 but it could have a decreasing cross-sectional area towards the outer end of the pipe 9.

Figure 8:
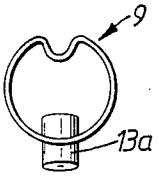
FIG. 8 is an end view of another form of shower pipe.

Instead of using an insert to reduce the effective cross-sectional area of the pipe 9 the pipe itself can be deformed, for example as illustrated in FIG. 8. Such a shower pipe is only suitable for use at low pressures because of the weakening effect of the deformation. The degree of deformation can vary along the length of the pipe so that the effective cross-sectional area of the pipe reduces towards its outer end.

Although the shower pipes described above are all intended for use with a circular filter in a device of the type shown in FIG. 1, similar shower pipes could be used to clean/recondition other filters or conveying surfaces. For example, a shower pipe similar to any one of those shown in the drawings could be mounted to extend across a papermaker's felt, the shower being brought into operation as required to direct a spray of liquid at the felt and restore the permeability of the felt to a required value. A shower of this type is described, for example, in European Patent Specification No. 0 009 399.

Moreover, although the shower pipes 9 are described as being of particular use in showers for the papermaking industry they are also of use in any similar shower apparatus utilizing filtered water.

Finally, it will be understood that, although each of the shower pipes described above has a circular cross-section (at least initially), this is not essential and cylindrical pipes of non-circular cross-section could be used.

What is claimed is:

1. In a papermaking machine, a shower apparatus comprising:

at least one shower pipe formed from a hollow member, the pipe being restricted at one end, the other end being arranged for connection to a liquid supply, a liquid supply passageway extending, within the pipe, from said other end to the said one end, and having a passageway cross-sectional area and a plurality of liquid discharge nozzles along the length of the pipe for discharging liquid flow along the passageway, said passageway cross-sectional area decreasing toward said one end of the said pipe for increasing the minimum liquid velocity within the passageway sufficiently to substantially prevent separation of solids from the liquid within the passageway.

2. Shower apparatus as claimed in claim 1, in which the cross-sectional area of the passageway is such that, in operation, the minimum liquid velocity in the passageway, at least at the first nozzle, is 8 ft/sec (2.6 m/sec).

3. Shower apparatus as claimed in claim 1, in which the cross-sectional area of the passageway varies along its length in such a manner that, in operation, the minimum liquid velocity in the passageway is 8 ft/sec (2.6 m/sec).

4. Shower apparatus as claimed in claim 1, in which the cross-sectional area of the passageway decreases continuously towards the said one end of the pipe.

5. Shower apparatus as claimed in claim 1 in which the liquid passageway is defined by at least one member located within the pipe.

6. Shower apparatus as claimed in claim 5, in which the liquid passageway is defined by at least one partition within the pipe.

7. Shower apparatus as claimed in claim 6, which the liquid passageway is defined by two or more partitions within the pipe, each partition defining a length of the passageway having a respective cross-sectional area.

8. Shower apparatus as claimed in claim 5, in which the liquid passageway is defined by an insert so located in the pipe that the remaining space within the pipe constitutes the liquid passageway.

9. Shower apparatus as claimed in claim 8, in which the cross-sectional area of the insert varies along its length.

10. Shower apparatus as claimed in claim 1, in which the said cylindrical member is deformed to reduce the crosssectional area of the interior of the member, and in which the interior of the deformed member constitutes the liquid supply passageway.

11. Shower apparatus as claimed in claim 1, in which at least that length of the pipe in which the said discharge nozzles are provided is unsupported.

12. In a papermaking machine, a method of operating shower apparatus which includes: at least one shower pipe formed from a hollow member, the pipe being restricted at one end; a liquid supply passageway which extends within the pipe from the other end thereof to the said one end and which, over part at least of the length of the pipe, has a decreased cross-sectional area; and a plurality of liquid discharge nozzles along the length of the pipe for discharging liquid from the supply passageway, wherein the method includes the step of supplying liquid to the said other end of the shower pipe and causing the liquid to flow along the supply passageway at a velocity sufficient to prevent separation of solids from the liquid.

13. A method as claimed in claim 12, in which the liquid velocity in the passageway is at least 8 ft/sec (2.6 m/sec), at least at the first nozzle.

* * * * *